United States Patent [19]

Nakazato et al.

[11] Patent Number: 4,530,708

[45] Date of Patent: Jul. 23, 1985

[54] AIR SEPARATION METHOD AND APPARATUS THEREFOR

[75] Inventors: Norio Nakazato; Sachihiro Yoshimatsu; Makoto Nawata; Sadao Masuda, all of Kudamatsu, Japan

[73] Assignee: Hitachi, Ltd., Tokyo, Japan

[21] Appl. No.: 494,448

[22] Filed: May 13, 1983

[30] Foreign Application Priority Data

May 14, 1982 [JP] Japan ..... 57-79932

[51] Int. Cl.³ ..... F25J 3/04

[52] U.S. Cl. ..... 62/13; 62/34; 62/39

[58] Field of Search ..... 62/38, 39, 33, 26, 30, 62/41, 32, 31, 29, 12, 13

[56] References Cited

U.S. PATENT DOCUMENTS 2,817,215 12/1957 Sixsmith ..... 62/33

*Primary Examiner*—Frank Sever

*Attorney, Agent, or Firm*—Antonelli, Terry & Wands

[57] ABSTRACT

This invention relates to an air separation method and apparatus for liquefying and separating feed air into oxygen and nitrogen by use of a single rectification column. The temperature of the feed air, which is liquefied, is reduced to the temperature necessary for the condensation and liquefaction of pure vaporous nitrogen inside the single rectification column and is used to condense and liquefy the pure vaporous nitrogen and vaporize the feed air. After the pressure of the feed air thus vaporized is raised to the pressure necessary for the condensation and liquefaction of the pure vaporous nitrogen inside the single rectification column, the vaporized feed air is introduced into the single rectification column so that pure gaseous nitrogen can be withdrawn from the top of the single rectification column, pure gaseous oxygen from a lower portion of the column and waste gas rich in nitrogen from an intermediate portion of the column. Thus, the present invention makes it possible to carry out air separation with a high rate of recovery of oxygen using a single rectification column.

4 Claims, 3 Drawing Figures

AIR SEPARATION METHOD AND APPARATUS THEREFOR

BACKGROUND OF THE INVENTION

This invention relates to an air separation method and apparatus. More particularly, the present invention relates to an air separation method and apparatus which are suitable for separating air in a single rectification column with a high recovery rate of oxygen with small power consumption per unit of oxygen.

In general, power consumption per unit of oxygen, that is, the energy supply required for the separation of a unit of the product, as well as a degree of reduction in size and structural simplicity of components used, are factors considered for evaluating the efficiency of air separators. The power consumption per unit of oxygen is a function between the recovery rate of separated gas products, for example, oxygen gas, and the discharge/intake pressure by a feed air compressor, that is, the higher the recovery rate of oxygen gas is or the lower the discharge pressure in the feed air compressor is, the smaller the power consumption per unit of oxygen. In other words, provided the cases are equivalent in compact size and structural simplicity of component equipment, the smaller the power consumption per unit of oxygen, the higher the efficiency of the air separators.

In accordance with the prior art, especially in its early stages, air separation has been effected by use of an air separator using a single rectification column in which a large number of plates are provided in the direction of its height, and a condenser is provided at the bottom immersed in liquid oxygen. Feed air that is compressed by an air compressor and that is cooled by a heat exchanger for cooling the feed air is subjected to a heat exchange in the condenser with the liquid oxygen therearound, is condensed and liquefied thereby and is thereafter supplied into the single rectification column from its upper portion as a reflux liquid. At the same time, the liquid oxygen around the condenser is vaporized and is converted into an upwardly flowing vapor. This upwardly flowing vapor comes into vapor-liquid contact with the reflux liquid on the plates and thus rectification proceeds. As a result, a gas rich in nitrogen (nitrogen-rich gas) is withdrawn from the top of the single rectification column, and gaseous oxygen having a high purity is taken from the bottom of the column.

In accordance with the air separation method and apparatus of the type described above, the size reduction and structural simplicity factors are superior due to the air separation performed in a single rectification column; however, the reflux liquid supplied from the upper portion of the single rectification column has the composition of air. Accordingly, though pure gaseous oxygen can be withdrawn from the bottom of the column, the upper limit of the nitrogen concentration of the gas withdrawn from the top of the column is 93%, and the recovery rate of the oxygen remains at a low level. Hence, there is still the problem that the power consumption per unit of oxygen is high.

For this reason, air separation is carried out nowadays by an air separator using a double rectification column consisting of a lower column incorporating a large number of plates aligned in the direction of its height and operating at a high pressure, and an upper column thermally coupled to the lower column by a reboiler-condenser, incorporating a large number of plates in the direction of its height and operating at a low pressure. Feed air that is compressed by an air compressor and cooled by a heat exchanger is introduced as an upwardly flowing vapor into the lower portion of the lower column. This upwardly flowing vapor is condensed and liquefied by the reboiler-condenser into a reflux liquid which flows down through the lower column. During this time, this reflux liquid comes into vapor-liquid contact with the upwardly flowing vapor on the plates, a preparatory rectification occurs so that liquid nitrogen having a high purity can be obtained at the top of the lower column and liquefied air rich in oxygen (about 38% $O_2$) can be obtained at the bottom. The pure liquid nitrogen and the liquefied air rich in oxygen are withdrawn from the lower column at their respective positions and, after being expanded to the pressure of the upper column in expansion valves, they are supplied to the upper column from its top and its intermediate portion as a reflux liquid for the upper column.

Liquid oxygen at the bottom of the upper column is heated by the nitrogen at the top of the lower column in the reboiler-condenser and is vaporized into an upwardly flowing vapor in the upper column. This upwardly flowing vapor comes into vapor-liquid contact with the reflux liquid on the plates so that pure gaseous nitrogen can be withdrawn from the top of the upper column, pure gaseous oxygen from the bottom, and waste gas rich in nitrogen (about 97% $N_2$), from an intermediate portion of the column.

This air separation method and apparatus provides a greatly improved recovery rate of oxygen an a reduced power consumption per unit of oxygen; however apparatus is complicated in construction and has a relatively large size since the rectifying column consists of upper and lower columns, thereby adversely affecting the size reduction and structural simplicity factors.

SUMMARY OF THE INVENTION

It is therefore an object of the present invention to provide an air separation method and apparatus which significantly reduces the size of the apparatus and which is structurally simple by employing a single recitication column and which can reduce the power consumption per unit of oxygen by improving the recovery rate of oxygen.

By virtue of the features and apparatus of the method and apparatus of the present invention, feed air is first compressed to be pressurized, with the feed air so pressurized being cooled down with pure vaporous nitrogen, pure gaseous oxygen, and waste gas in the form of impure vaporous nitrogen from a single rectification column. The so-cooled feed air is then delivered to the single rectification column in which it is indirectly heat exchanged with liquid oxygen at the bottom of the rectification column so that the liquid oxygen is vaporized while the feed air is condensed to be liquified. The liquified feed air is further cooled down to a level enough to condense and liquify pure vaporous nitrogen in the single rectification column, and the so further cooled feed air is indirectly heat exchanged with pure vaporous nitrogen in the single rectification column so that the pure vaporous nitrogen is condensed to be liquified while the liquified feed air is vaporized. Then, after the feed air is vaporized, and has been pressurized to a level sufficient to condense and liquify the pure vaporous nitrogen, the feed air is introduced into the single rectification column in which a mixture formed by joining the introduced feed air and oxygen vapor produced by the vaporization of the liquid oxygen, i.e., upwardly flowing vapors, rich in nitrogen, are put in vapor-liquid contact with the downwardly flowing pure vaporous nitrogen condensed and liquified in the single rectification column and are separated into pure vaporous nitrogen at the top of the single rectification column and pure liquid oxygen at the bottom of the single rectification column. The pure vaporous nitrogen and pure liquid oxygen are taken out from the single rectification column as pure gaseous nitrogen and pure gaseous oxygen.

By virtue of the above noted features of the present invention, it is possible to realize a significant size reduction and structural simplicity of the component equipment with small power consumption per unit of oxygen while using a single rectification column.

BRIEF DESCRIPTION OF THE DRAWINGS

FIG. 1' is a block diagram of the embodiment shown in FIG. 1 with the operating conditions employed in one example of the operation of the method of this invention.

DESCRIPTION OF THE PREFERRED EMBODIMENTS

Figure 1:
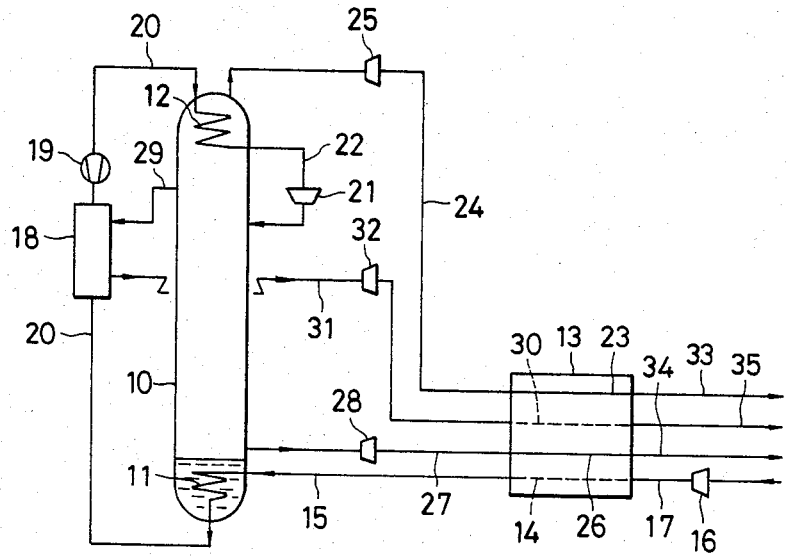
FIG. 1 is a block diagram showing the system of the air separator in accordance with one embodiment of the present invention.

In FIG. 1, a first condenser 11 is provided within the bottom of a single rectification column 10, immersed in liquid oxygen. The column 10 incorporates a large number of plates (not shown) arranged in the direction of its height. The plates equipped inside column 10 are arranged at several tens of stages at intervals, which intervals top to bottom are 80 mm to 200 mm and are provided in the space shown except for the spaces of condensers 11 and 12 located in column 10. A second condenser 12 is incorporated within the top of the column 10. The inlet of a heat exchanger for cooling the feed air, such as a reversing heat exchanger 13, is connected to a conduit 15 whose other end is connected to the outlet of a feed air passage 14. The inlet of this passage 14 is connected to an air compressor 16 via a conduit 17. The outlet of the first condenser 11 and the inlet of the second condenser 12 are connected to each other by a conduit 20 in which a liquid air supercooler 18 and means for reducing the pressure and temperature of the liquid air, such as an expansion valve 19, are provided. The outlet of the second condenser 12 and an intermediate portion of the single rectification column 10 are connected to each other by a conduit 22 in which an air compressor 21 is provided.

A conduit 24, which is connected to the inlet of a nitrogen gas passage 23 of the reversing heat exchanger 13, is connected to the top of the single rectification column 10. A cold generation means, such as an expansion turbine 25, is provided in the flow path of the conduit 24. A conduit 27, which is connected to the inlet of an oxygen gas passage 26 of the reversing heat exchanger 13, is connected to a lower portion of the single rectification column 10. An expansion turbine 28 is provided in this conduit 27. A conduit 29, which is connected to the liquid air supercooler 18, is connected to an intermediate portion of the single rectification column 10. A conduit 31, which is connected to the inlet of a waste gas passage 30 capable of switching the passages of the reversing heat exchanger 13, is connected to the liquid air supercooler 18. An expansion turbine 32 is provided in this conduit 31. Conduits 33, 35 and 34 are connected to the outlets of the nitrogen gas passage 23, the oxygen gas passage 26 and the waste gas passage 30, respectively, of the reversing heat exchanger 13.

It will be understood that feed air passage 14 and waste gas passage 30 are changed over periodically. For this reason, dashed lines are used to discriminate nitrogen gas passage 23 and oxygen gas passage 26 which are free from such change-over. That is, if line 14 and line 30 are changed over periodically, feed air passage may be lines 17, 14 and 15 some time, where waste gas passage must be lines 31, 30 and 35, but feed air passage becomes, after changed over, lines 17, 30 and 15, where waste gas passage turns lines 31, 14 and 35. It follows that the fluid in lines 14 and 30 is feed air and waste gas alternatively.

The feed air, whose pressure is raised to at least 4.2 kg/cm$^2$, preferably to 5.2 kg/cm$^2$, by the air compressor 16 is supplied to the feed air passage 14 of the reversing heat exchanger 13 through the conduit 17. In the process, the feed air is cooled and the moisture and $CO_2$ gas therein are removed. This aspect of the invention is closely related to the above cyclic change-over of feed air passage 14 and waste gas passage 30. Heat exchanger 13 is cooled with gases withdrawn from the rectifying column, i.e., pure gaseous nitrogen, pure gaseous oxygen and waste gas. The moisture and $CO_2$ in the feed air is turned, while passing line 14, into ice, and dry ice respectively, and condensed on the heating surface and thereby removed. As passage line 14 is changed over before it is blocked, waste gas begins passing line 14 and this waste gas sweeps the above ice and dry ice to take out to the outside through line 35. In this time, the feed air passes line 30, and moisture and $CO_2$ gas in it is further condensed on the heating surface thereof and removed. This operation repeats and during this repeated operation moisture and $CO_2$ gas can be removed to allow smooth continuous operation of the apparatus. After the moisture and $CO_2$ gas are thus removed, the feed air is supplied from the reversing heat exchanger 13 to the condenser 11 through the conduit 15. The condensation temperature of this feed air is 96° K. when its pressure is 4.2 kg/cm$^2$ and 98.6° K. when the pressure is 5.2 kg/cm$^2$. While passing through the condenser 11, therefore, the feed air is cooled, condensed and liquefied by the liquid oxygen whose temperature is lower than the condensation temperature of the feed air by the temperature necessary for the heat exchange and being generally between 1° to 2° K., while part of the liquid oxygen is vaporized. The feed air thus liquefied in the condenser 11 is supplied therefrom to the liquid air supercooler 18 (which is an indirect exchanger) through the conduit 20. The temperature in the supercooler 18 is 91° K. when the feed air pressure is 4.2 kg/cm$^2$, and 93.6° K. when it is 5.2 kg/cm$^2$. The feed air is cooled in the liquid air supercooler 18 by waste gas rich in nitrogen (hereinafter referred to as the "waste gas") which is withdrawn from an intermediate portion of the single rectification column 10 and is supplied to the liquid air supercooler 18 through the conduit 29. It will be understood that waste gas is withdrawn at such a location range, called "intermediate portion", that nitrogen concentration in column 10 is approximately 97%. Waste gas outlet temperature is 79.7° K. and higher (preferably 82.0° K.), and waste gas outlet pressure is 1.3 kg/cm$^2$ and higher (preferably 1.73 kg/cm$^2$). The liquefied air thus further cooled leaves the liquid air supercooler 18 and reaches the expansion valve 19 through the conduit 20. The liquid air is expanded in the expansion valve 19 to at least 1.03 kg/cm$^2$, preferably to 1.2 kg/cm$^2$ so that the temperature is reduced to the necessary level at which the pure vaporous nitrogen inside the single rectification column 10 can be condensed and liquefied. Due to this expansion, the boiling temperature of the liquefied air is reduced to at least 78.7° K., preferably to 80.0° K. Thereafter, it is supplied to the condenser 12 through the conduit 20. The temperature of liquefied air inside condenser 12 is 78.7° to 80.0° K. (In order to have outside pure vaporous nitrogen condensed, temperature must be 1° to 2° K. higher than said degrees. Therefore, the outside fluid temperature is 79.7° K. to 81.7° K.) In the process, it condenses and liquefies the pure vaporous nitrogen having a temperature of at least 79.7° K., preferably 81.7° K., around it while the liquefied air itself is vaporized. The feed air formed by the vaporization of this liquefied air is supplied from the condenser 12 to the air compressor 21 through the conduit 22, where its pressure is raised to at least 1.36 kg/cm$^2$, preferably to 1.8 kg/cm$^2$, so as to provide the pressure necessary for condensing and liquefying the pure vaporous nitrogen inside the single rectification column 10. After the pressure is thus raised, the feed air is introduced into an intermediate portion of the single rectification column 10 through the conduit 22.

Inside the single rectification column 10, the oxygen vapor vaporized from part of the liquid oxygen remaining at the bottom of the column joins with the feed air introduced from the intermediate portion of the column and they rise as upwardly flowing vapor. On the other hand, the pure vaporous nitrogen that has been condensed and liquefied by the liquid air flowing through the condenser at the top of the single rectification column 10 becomes a reflux liquid and flows down inside the rectification column 10. The upwardly flowing pure vaporous nitrogen and the reflux liquid come into a vapor-liquid contact, whereby rectification proceeds. Accordingly, pure gaseous nitrogen can be separated from the top of the column, and liquid oxygen having a high purity from the bottom of the column. The pure gaseous nitrogen is withdrawn from the top of the single rectification column 10 through the conduit 24 and pure gaseous oxygen, from its bottom through the conduit 27. The pure gaseous nitrogen (i.e. nitrogen with concentration of about 99.999%) and pure gaseous oxygen (i.e. oxygen with a concentration of about 99.6%) thus withdrawn are expanded substantially to atmospheric pressure by the expansion turbines 25 and 28, respectively, and are supplied to the nitrogen gas passage 23 and oxygen gas passage 26 of the reversing heat exchanger 13, respectively. While passing through their respective passages, they cool the feed air passing through the feed air passage 14. Thereafter, the pure gaseous nitrogen and the gaseous oxygen are discharged from the conduits 33 and 34, respectively.

Waste gas is withdrawn from an intermediate portion of the single rectification column 10 through the conduit 29. After further cooling the liquid air in the liquid air supercooler 18, this waste gas is supplied via the conduit 31 to the expansion turbine 32, where the waste gas is expanded substantially to atmospheric pressure, and is then supplied to the waste gas passage 30 of the reversing heat exchanger 13 through the conduit 31. After passing through the waste gas passage 30, the waste gas is discharged through the conduit 35. The expansion turbines 25, 28 and 32 expand the pure gaseous nitrogen, the pure gaseous oxygen and the waste gas from their respective pressures to close the atmospheric pressure, thereby generating the cold necessary for the air separator. This cold temperature cools the feed air inside the reversing heat exchanger 13.

Cooling of the feed air during start-up is performed as follows. A cool source is generated by means of expansion turbines 25, 28 and 32. Gas is adiabatically expanded by these expansion turbines and so this gas falls in temperature, which will make heat exchanger 13 cooled step-by-step and accordingly the feed air is cooled gradually by heat exchanger 13. As this cooling advances, condenser 12 operates to condense air around itself and generate liquid air. Then, when column 10 has been wholly cooled, liquid air is accumulated at the bottom of the column, and when the liquid air has been accumulated, condenser 11 operates. Then ascending gas and descending liquid come in contact on the plates, when rectification takes place. When rectification has been effected, nitrogen gas exists at the top of the column and liquid oxygen is at the bottom.

The air separation method and apparatus described above provides the following effects:

(1) It can eliminate the problem with the prior art using a conventional single rectification column that the recovery rate of oxygen is low, and can reduce the power consumption per unit of oxygen because a high rate of recovery of oxygen can be secured.

(2) Since the conventional double rectification column can be replaced by a single rectification column, the rectifying column can be made more compact with structurally simple components and the production cost of the system can be reduced.

Although the compressor and expansion turbine for the waste gas are disposed separately in the embodiment described above, a turbine compressor consisting of a compressor connected in series with an expansion turbine may also be provided.

The second embodiment of the present invention will be described with reference to FIG. 2, in which like reference numerals are used to identify like elements shown in FIG. 1.

Figure 2:
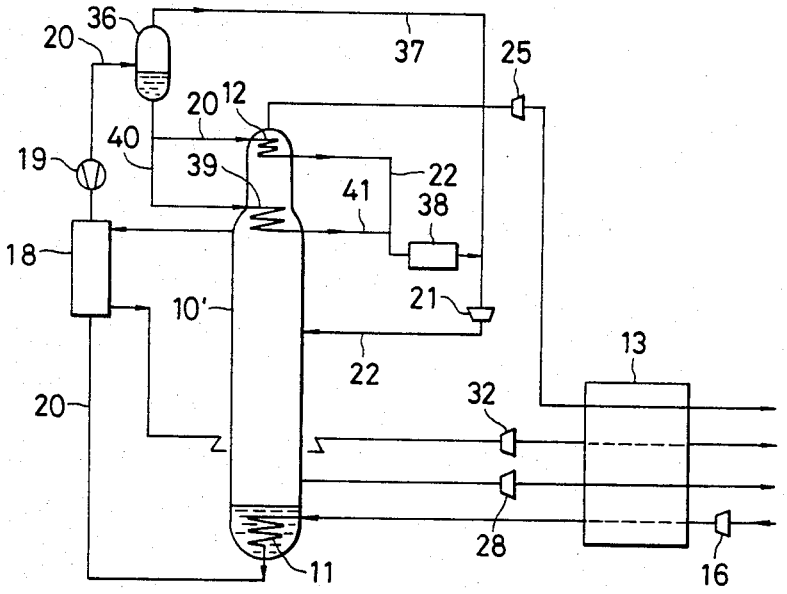
FIG. 2 is a block diagram showing the system of the air separator in accordance with another embodiment of the present invention.
Figure 1:
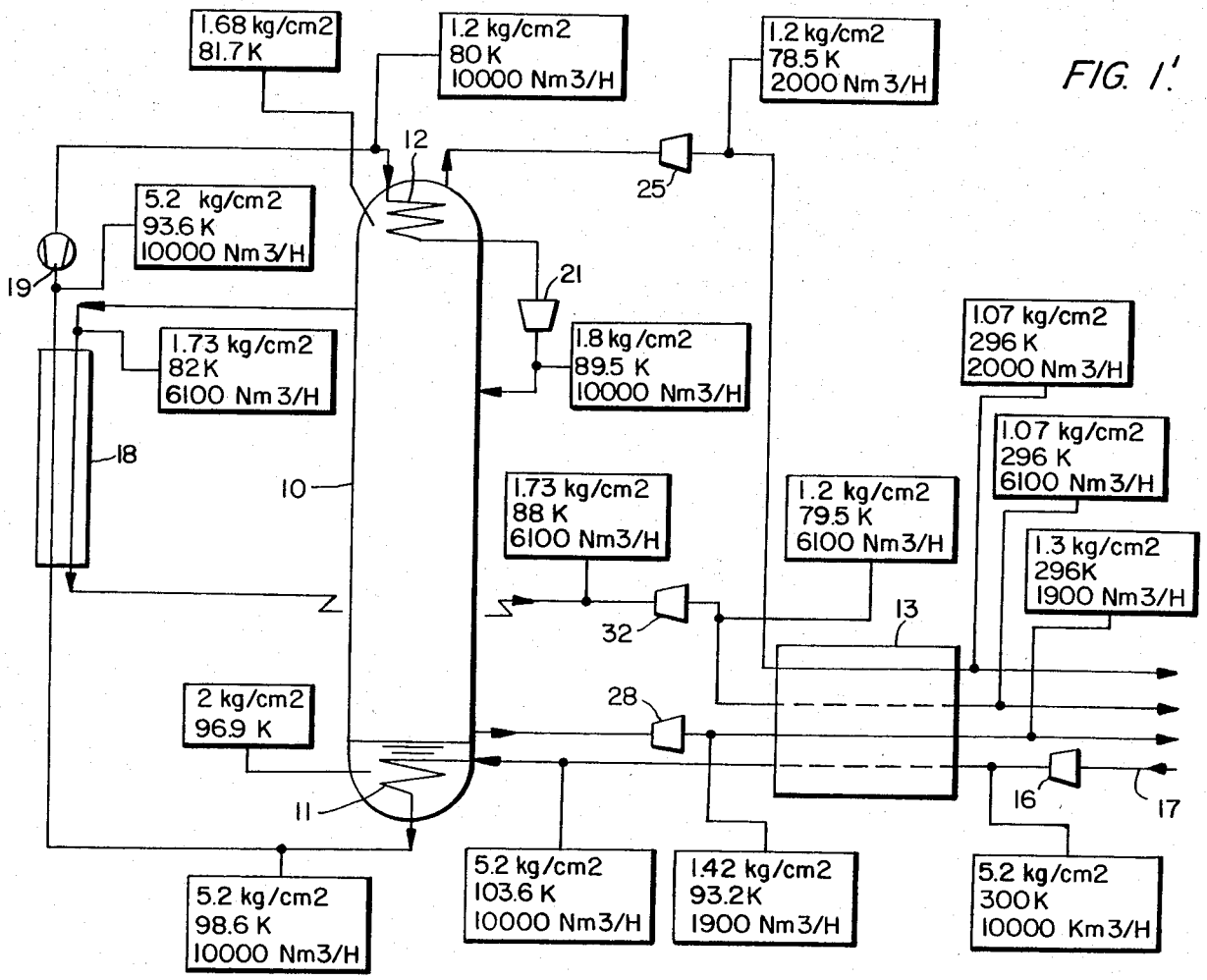

In FIG. 2, a mist separator 36 is provided between the expansion valve 19 of the conduit 20 and the condenser 12. A conduit 37 is connected to the top of this mist separator 36 and to the conduit 22 upstream of the compressor 21. The temperature within the mist separator 36 is 78.7° K. and higher (preferably 80.0° K.), and pressure there is 1.03 kg/cm$^2$ and higher (preferably 1.2 kg/cm$^2$). A mist evaporator 38 is provided in the conduit 22 upstream of the compressor 21. A third condenser 39 is incorporated at an intermediate portion within the single rectification column 10'. A conduit 40, which branches from the conduit 20 between the mist separator 36 and the condenser 12, is connected to the inlet of the third condenser 39; and a conduit 41, which branches from the conduit 22 between the condenser 12 and the mist evaporator 38, is connected to the outlet thereof.

While being expanded by the expansion valve 19 to at least 1.03 kg/cm$^2$, preferably to 1.2 kg/cm$^2$, the liquid air is partially vaporized, becomes a liquid-vapor mixing phase and is supplied to the mist separator 36 through the conduit 20. The liquid air and the vaporized feed air are separated inside the mist separator 36. A predetermined quantity of the liquid air thus separated is passed to the condenser 12 from the mist separator 36 through the conduit 20, and the rest is supplied to the condenser 39 through the conduits 20 and 40. The liquid air flowing through the condenser 12 is vaporized while condensing and liquefying the pure vaporous nitrogen flowing upwardly in the column 10', and the liquid air flowing through the condenser 39 is vaporized while condensing and liquefying the upwardly flowing nitrogen-rich gas. The liquid feed air vaporized in the condenser 12 is supplied to the mist evaporator 38 through the conduit 22, while the feed air vaporized in the condenser 39 is supplied to the mist evaporator 38 through the conduits 41 and 22. The mist evaporator 38 completely evaporates the mist contained in these two supplies of feed air. This feed air is compressed by the compressor 21 to at least 1.36 kg/cm$^2$, preferably to 1.8 kg/cm$^2$, together with the feed air that flows from the mist separator 36 into the conduit 22' through the conduit 37 and is then introduced into an intermediate portion of the single rectification column 10' through the conduit 22'. The feed air rises as upwardly flowing gas inside the single rectification column 10' together with vaporized oxygen from the liquid oxygen.

It will be appreciated that the temperature of liquid air in the columns by the second condenser is 78.7° K. and higher (preferably 80.0° K.) and that of nitrogen-rich gas outside the columns is 79.7° K. and higher (preferably 82.0° K.).

In addition to the effects of the first embodiment, this second embodiment provides the following effects:

(1) Since the quantity of pure vaporous nitrogen condensed and liquefied at the top of the single rectification column can be reduced to the quantity necessary, the size of the top of the column can be reduced.

(2) Liquid air as a mist is not contained in the feed air supplied to the compressor by the action of the mist separator in cooperation with the mist evaporator, and hence the compressor can be operated more stably.

In the first and second embodiments of the invention described above, the compressor and the expansion turbine for the waste gas are disposed separately, but a turbine compressor consisting of a compressor connected in series with an expansion turbine may be provided instead. In these embodiments, too, the liquid air is supercooled by using the waste gas before it is supplied to means for reducing the temperature and pressure of the liquid air, but this liquid air may also be supercooled by the pure gaseous nitrogen withdrawn from the top of the single rectification column.

As described in the foregoing, the present invention has a construction in which compressed and cooled feed air is liquefied; the temperature of the liquid air is reduced to the temperature necessary for the condensation and liquefaction of pure vaporous nitrogen inside a single rectification column; the liquid air whose temperature is thus reduced is subjected to a heat exchange with the pure vaporous nitrogen inside the single rectification column so as to condense and liquefy the pure vaporous nitrogen and vaporize the liquid air; the pressure of the feed air thus vaporized is raised to the pressure necessary for the condensation and liquefaction of the pure vaporous nitrogen inside the single rectification column; the vaporized feed air is then introduced into the single rectification column; and pure gaseous nitrogen is withdrawn from the top of the single rectification column, pure gaseous oxygen is withdrawn from a lower portion of the column, and waste gas is withdrawn from an intermediate portion of the column. Accordingly, the present invention can secure a high rate of recovery of oxygen and can reduce the power consumption per unit of oxygen, the size of the rectification column and the production cost of the system.

The method of this invention will be further understood from the following example of the operation of the embodiment shown in FIG. 1 for obtaining pure gaseous nitrogen and pure gaseous oxygen, with the operating conditions being shown by appropriate legends in FIG. 1'. The conditions of pressure, temperature, flow rate, etc., are set forth in the following table:

| Process Stream or Unit | Conditions |
|---|---|
| Conduit line 17 | 5.2 kg/cm$^2$<br>300° K.<br>10000 Nm$^3$/H |
| Conduit line 15 | 5.2 kg/cm$^2$<br>103.6° K.<br>10000 Nm$^3$/H |
| Conduit line 20 exiting from condenser 11 | 5.2 kg/cm$^2$<br>98.6° K.<br>10000 Nm$^3$/H |
| Bottom of column 10 at condenser 11 | 2 kg/cm$^2$<br>96.9° K. |
| Conduit line 20 exit-from supercooler 18 | 5.2 kg/cm$^2$<br>93.6° K.<br>10000 Nm$^3$/H |
| Conduit line 20 entering condenser 12 | 1.2 kg/cm$^2$<br>80° K.<br>10000 Nm$^3$/H |
| Conduit line 22 exiting from air compressor 21 | 1.8 kg/cm$^2$<br>89.5° K.<br>10000 Nm$^3$/H |
| Conduit line 29 entering supercooler 18 | 1.73 kg/cm$^2$<br>82° K.<br>6100 Nm$^3$/H |
| Conduit line 31 entering expansion turbine 32 | 1.73 kg/cm$^2$<br>88° K.<br>6100 Nm$^3$/H |
| Conduit line 31 exiting from expansion turbine 32 | 1.2 kg/cm$^2$<br>79.5° K.<br>6100 Nm$^3$/H |
| Conduit line 35 | 1.07 kg/cm$^2$<br>296° K.<br>6100 Nm$^3$/H |
| Conduit line 27 exiting from expansion turbine 28 | 1.42 kg/cm$^2$<br>93.2° K.<br>1900 Nm$^3$/H |
| Conduit line 34 exiting from reversing heat exchanger 13 | 1.3 kg/cm$^2$<br>296° K.<br>1900 Nm$^3$/H |
| Conduit line 24 exiting from expansion turbine 25 | 1.2 kg/cm$^2$<br>78.5° K.<br>2000 Nm$^3$/H |
| Conduit line 33 exting from reversing heat exchanger 13 | 1.07 kg/cm$^2$<br>296° K.<br>2000 Nm$^3$/H |
| Top of column 10 adjacent to condenser 12 | 1.68 kg/cm$^2$<br>81.7° K. |

We claim:

1. A method of separating air comprising the steps of:

compressing feed air so as to pressurize the same;

cooling the compressed feed air with pure vaporous nitrogen, pure gaseous oxygen, and waste gas rich in nitrogen from a single rectification column;

delivering the cooled feed air to the single rectification column;

subjecting the delivered cooled feed air to an indirect heat exchange with liquid oxygen at a bottom of the single rectification column so that the liquid oxygen is vaporized while the feed air is condensed so as to be liquified;

further cooling the liquified feed air to a level sufficient to condense and liquify pure vaporous nitrogen in the single rectification column;

subjecting the further cooled liquified feed air to an indirect heat exchange with pure vaporous nitrogen at a top of the single rectification column so that the pure vaporous nitrogen is condensed to be liquified while the liquified feed air is vaporized;

introducing the vaporized feed air into the single rectification column after the vaporized feed air is pressurized to a level sufficient to condense and liquify the pure vaporous nitrogen;

forming a mixture by joining the vaporized feed air introduced into the single rectifying column with oxygen vapor from the vaporization of the liquid oxygen at the bottom of the single rectification column whereby the mixture of oxygen vapor and feed air rising as an upwardly flowing vapor in the single rectification column comes into a vapor-liquid contact with the liquified nitrogen to result in a separation into pure vaporous nitrogen at the top of the single rectification column and pure liquid oxygen at the bottom of the single rectification column; and withdrawing the pure gaseous nitrogen from the top of the single rectification column, pure gaseous oxygen from the bottom of the column and waste gas from an intermediate portion of the column.

2. The method of separating air as defined in claim 1, wherein the liquefied feed air is supercooled by waste gas or pure gaseous nitrogen withdrawn from the single rectification column, and is then expanded so as to reduce its temperature to the temperature necessary for the condensation and liquefaction of the pure vaporous nitrogen inside the single rectification column.

3. An air separator comprising:

an air compressor means for compressing feed air;

a heat exchanger means for cooling the feed air compressed by said air compressor means;

a single rectification column means for performing an air separation;

a first condenser means accommodated in the single rectification column means at the bottom thereof for vaporizing liquid oxygen and for condensing and liquifying the feed air by indirect heat exchange between liquid oxygen at the bottom of the single rectification column and the compressed feed air cooled by said heat exchanger means;

means for further cooling and reducing the pressure of the liquified air to a temperature necessary for the condensation and liquification of pure vaporous nitrogen inside said single rectification column means;

a second condenser means accommodated in the single rectification column means at the top thereof for condensing and liquifying pure vaporous nitrogen and for vaporizing the liquified feed air by indirect heat exchange between the further cooled liquified feed air and pure vaporous nitrogen in the single rectification column means;

a second compressor means for introducing into the single rectification column means feed air vaporized by said second condenser means after the feed air has been pressurized to the pressure necessary for the condensation and liquification of the pure vaporous nitrogen inside said single rectification column by said second condenser means.

4. The air separator as defined in claim 3, wherein said second condenser means provided within the top of said single rectification column means is used as a condenser means for vaporizing part of the feed air which is condensed and liquified by said first condenser means and whose temperature is reduced by said means for reducing the temperature and pressure of the feed air, and a third condenser means for vaporizing the rest of the liquified feed air is provided within an intermediate portion of said single rectification column means.

* * * * *